United States Patent [19]

Ogita

[11] 4,208,663

[45] Jun. 17, 1980

[54] ANTENNA INPUT CIRCUIT FOR AM/FM RADIO RECEIVER

[75] Inventor: Minoru Ogita, Hamamatsu, Japan

[73] Assignee: Nippon Gakki Seizo Kabushiki Kaisha, Hamamatsu, Japan

[21] Appl. No.: 846,020

[22] Filed: Oct. 27, 1977

[30] Foreign Application Priority Data

Nov. 4, 1976 [JP] Japan ..... 51/148325

[51] Int. Cl.[2] ..... H01Q 21/30

[52] U.S. Cl. ..... 343/853; 455/277

[58] Field of Search ..... 343/852, 858, 853; 325/366, 372

[56] References Cited

U.S. PATENT DOCUMENTS

| | | | |
|---|---|---|---|
| 3,465,344 | 9/1969 | Scott | 343/858 |
| 3,725,942 | 4/1973 | Ukmar | 343/858 |
| 3,824,599 | 7/1974 | Haswell | 343/858 |
| 4,037,177 | 7/1977 | Tyrey | 343/858 |
| 4,085,405 | 4/1978 | Barlow | 343/858 |

FOREIGN PATENT DOCUMENTS

| | | | |
|---|---|---|---|
| 953985 | 12/1956 | Fed. Rep. of Germany | 343/853 |
| 1204113 | 1/1960 | France | 343/853 |

*Primary Examiner*—Eli Lieberman

*Attorney, Agent, or Firm*—Cushman, Darby & Cushman

[57] ABSTRACT

An antenna input circuit for an AM/FM radio receiver comprises an input transformer for FM broadcast reception, an input transformer for AM broadcast reception, at least one antenna terminal for the connection of the transmission line leading from an FM-receiving antenna, and a filter network connecting the antenna terminal to each primary winding of those input transformers. The filter network is such that from the antenna terminal, it feeds, with little loss, FM broadcast signals to the FM input transformer, while it feeds, with an allowable amount of loss, AM broadcast signals to the AM input transformer. Thus, the antenna input circuit allows an AM/FM receiver to receive either an FM broadcast or an AM broadcast by using only a single antenna and without changing the connection of the antenna transmission line.

12 Claims, 4 Drawing Figures

ANTENNA INPUT CIRCUIT FOR AM/FM RADIO RECEIVER

BACKGROUND OF THE INVENTION (a) Field of the Invention

The present invention is related to an antenna input circuit for an AM/FM radio receiver.

(b) Description of the Prior Art

With the conventional antenna input circuit for an AM/FM receiver, when receiving an AM broadcast, it is necessary to install an AM-receiving antenna in addition to an FM-receiving antenna and to connect the AM-receiving antenna to an antenna terminal provided exclusively for AM broadcast reception.

In FIG. 1 is shown an example of such a prior art antenna input circuit, which consists of an input transformer FMT for FM broadcast reception, an input transformer AMT for AM broadcast reception, antenna terminals $T_1$, $T_2$ and $T_4$ connected as shown in FIG. 1, and a terminal $T_3$ for making external grounding. The antenna terminal (jack) $T_1$ is connectible with a co-axial cable, i.e. an unbalanced transmission line, leading from an FM-receiving antenna; the antenna terminal $T_2$ is connectible with a twin-lead type feeder, i.e. a balanced transmission line, extending from an FM-receiving antenna; and the antenna terminal $T_4$ is connectible with a transmission line leading from an AM-receiving antenna. One contact of the terminal $T_1$ to which the shield sheath of the co-axial cable is to be connected is connected to the ground line of the antenna input circuit or the AM/FM receiver, and the other contact of the terminal $T_1$ to which the center wire of the co-axial cable is to be connected is connected to a lead of the primary winding of the input transformer FMT. A pair of contacts of the antenna terminal $T_2$ are connected to the corresponding leads of the primary winding of the input transformer FMT, respectively. The primary winding of the input transformer FMT has its center lead connected to the circuit ground line. The contact of the antenna terminal $T_4$ is connected to a lead of the primary winding of the input transformer AMT, the other primary winding lead and the contact of the terminal $T_3$ being connected to the circuit ground line, respectively.

As described above, the AM broadcast signal path and the AM-receiving antenna connection both are independent of those for FM broadcast reception, so that the prior art antenna input circuit has the inconvenience, in use, that installation and connection to the corresponding antenna terminals of both an FM-receiving antenna and an AM-receiving antenna is necessary.

SUMMARY OF THE INVENTION

It is, therefore, an object of the present invention to provide an antenna input circuit for an AM/FM radio receiver, which enables the receiver to receive either an FM broadcast or an AM broadcast by using only an FM-receiving antenna and without changing the connection of the transmission line from the FM-receiving antenna. In other words, according to the invention, the single antenna enables the receiver to spare a ferrite bar antenna conventionally used for AM-reception.

This and other objects as well as the features of the present invention will become apparent by reading the following detailed description of the preferred embodiments when taken in conjunction with the accompanying drawings.

BRIEF DESCRIPTION OF THE DRAWINGS

Like parts are indicated by like references and symbols throughout the drawings.

DETAILED DESCRIPTION OF THE PREFERRED EMBODIMENTS

Prior to the description of the embodiments of the present invention, brief description will hereunder be made on the basic arrangement of the antenna input circuit according to the present invention. The antenna input circuit of the present invention consists essentially of an input transformer for FM broadcast reception, an input transformer for AM broadcast reception, at least one antenna terminal for the connection of the transmission line from an FM-receiving antenna, and a filter network connecting the antenna terminal to each primary winding of those input transformers. FM broadcast signals received by the FM-receiving antenna and applied through the transmission line to the antenna terminal are fed, with little loss, to the input transformer for FM broadcast reception through the filter network. On the other hand, AM broadcast signals induced in the transmission line are fed with an allowable amount of loss to the input transformer for AM broadcast reception through the filter network.

Thus, an AM/FM radio receiver with the antenna input circuit according to the present invention is able to receive either an FM broadcast or an AM broadcast by installing only an FM-receiving antenna and connecting the transmission line from the antenna to the common antenna terminal of the antenna input circuit.

Figure 1:
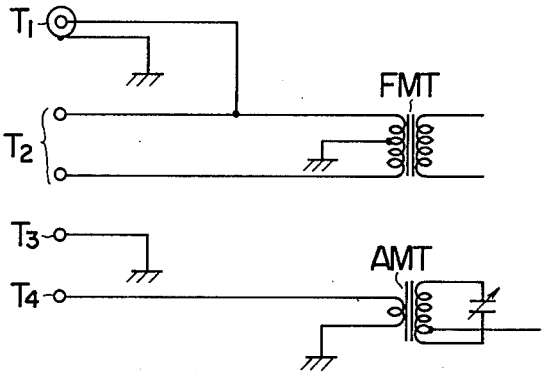
FIG. 1 PRIOR ART
FIG. 1 is an electric circuit diagram showing the antenna input circuit according to the prior art.
Figure 2:
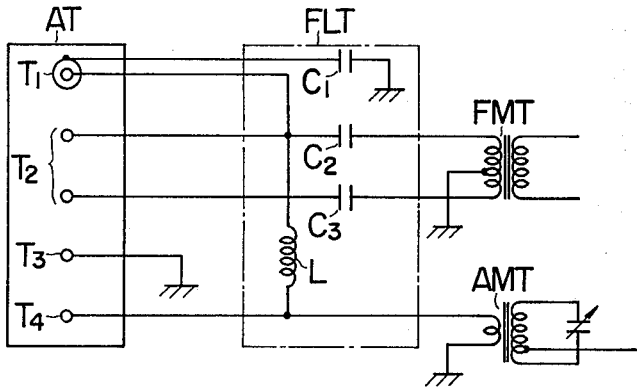
FIG. 2 is an electric circuit diagram showing an example of the antenna input circuit according to the present invention.

Referring now to FIG. 2, an example of the antenna input circuit according to the present invention will be explained hereunder. Antenna terminals $T_1$, and $T_2$ and $T_4$ and a ground terminal $T_3$ are assembled on a terminal board AT. The antenna terminal $T_1$ is connectible with a co-axial cable, an unbalanced transmission line with a characteristic impedance of 75 ohms from an FM-receiving antenna such as a plain dipole antenna. The antenna terminal $T_1$ has a pair of contacts, one of which is for the connection of the shield sheath of the coaxial cable thereto, and the other is to be connected to the center wire of the co-axial cable. The former contact is connected through a capacitor $C_1$ of a filter network FLT to the circuit ground line of the antenna input circuit, which usually is common to the ground line of the AM/FM radio receiver circuit employing this antenna input circuit. The latter contact of the antenna terminal $T_1$ is connected through a capacitor $C_2$ of the filter network FLT to a lead of the primary winding of an input transformer FMT for FM broadcast reception, and is also connected through an inductor L of the filter network FLT to a lead of the primary winding of an input transformer AMT for AM broadcast reception.

The antenna terminal $T_2$ is adapted to be connected with a twin-lead type feeder, a balanced transmission line with a characteristic impedance of 300 ohms from an FM-receiving antenna such as a folded dipole antenna. The antenna terminal $T_2$ has a pair of contacts for the connection of the respective wires of the twin-lead type feeder, the respective contacts being connected through the capacitors $C_2$ and $C_3$ to the corresponding leads of the primary winding of the input transformer FMT. One of the contacts of the antenna terminal $T_2$ is further connected through the inductor L of the filter network FLT to said lead of the primary winding of the input transformer AMT.

The ground terminal $T_3$ is intended for making external grounding of the antenna input circuit and connected to the ground line of the antenna input circuit. In case the circuit ground line is connected through an appropriate capacitor to the AC winding of the power supply transformer in the AM/FM radio receiver, the ground terminal $T_3$ may be omitted since the circuit ground line is externally grounded through the AC power line.

The antenna terminal $T_4$ is for the connection of a transmission wire from an AM-receiving antenna and is connected to said lead of the primary winding of the input transformer AMT.

The input transformer FMT has a center lead of its primary winding connected to the circuit ground line, and the other lead of the primary winding of the input transformer AMT is connected to the circuit ground line.

The capacitance value of each of the capacitors $C_1$, $C_2$ and $C_3$ is determined so that the capacitors $C_1$, $C_2$ and $C_3$ may offer a sufficiently large impedance against AM broadcast signals with frequencies of 525 kHz to 1605 kHz in Japan and the United States, for instance, as compared to the primary impedance of the input transformer AMT, but may offer a considerably smaller impedance than 75 ohms against FM broadcast signals of 76 MHz to 90 MHz in Japan or 88 MHz to 108 MHz in the United States, for instance. The inductor L has such an inductance value that it may offer a greatly larger impedance than 75 ohms against FM broadcast signals, but may offer sufficiently smaller impedance than the primary impedance of the input transformer AMT against AM broadcast signals.

The following table shows a typical value set for the capacitors $C_1$, $C_2$ and $C_3$ and the inductor L and the impedance values thereof against 100 MHz and 1 MHz signals.

| Signal frequency | Inductor L | Impedance $\omega L$ | Capacitors $C_1$, $C_2$, $C_3$ | Impedance $1/\omega C$ |
|---|---|---|---|---|
| 100MHz | 10μH | 6.3kΩ | 200pF | 8Ω |
| 1MHz | 10μH | 63Ω | 200pF | 800Ω |

It should be noted that this embodiment may be modified so that both contacts of the antenna terminal $T_2$ are connected to the primary winding lead of the input transformer AMT through the inductor L and an additional inductor similar to the inductor L.

Figure 3:
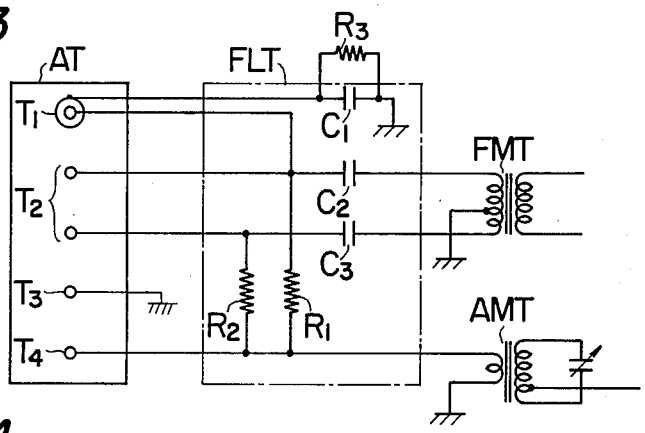
FIG. 3 is an electric circuit diagram showing another example of the antenna input circuit according to the present invention.

FIG. 3 shows another example of the antenna input circuit according to the present invention. This embodiment is different from the previous embodiment of FIG. 2 in that both contacts of the antenna terminal $T_2$ are connected to the primary winding lead of the input trasformer AMT through resistors $R_1$ and $R_2$ and that the capacitor $C_1$ is shunted by a resistor $R_3$. The resistor $R_3$ makes a leakage path for AM broadcast signals induced in the shield sheath of the co-axial cable which is to be connected to the antenna terminal $T_1$ to thereby attenuate the AM broadcast signals to an optimum level. The resistance values of the resistors $R_1$ and $R_2$ are such that they are sufficiently larger than the impedances of the capacitors $C_1$, $C_2$ and $C_3$ against FM broadcast signals.

It should be noted that the resistors $R_2$ and $R_3$ may, if allowed, be omitted.

An example of the value set for the capacitors $C_1$, $C_2$ and $C_3$ and resistors $R_1$ and $R_2$ and the impedance values thereof against 100 MHz and 1 MHz signals are shown in the following table.

| Signal frequency | Resistors $R_1$, $R_2$ | Impedance R | Capacitors $C_1$, $C_2$, $C_3$ | Impedance $1/\omega C$ |
|---|---|---|---|---|
| 100MHz | 1kΩ | 1kΩ | 100pF | 16Ω |
| 1MHz | 1kΩ | 1kΩ | 100pF | 1.6kΩ |

Figure 4:
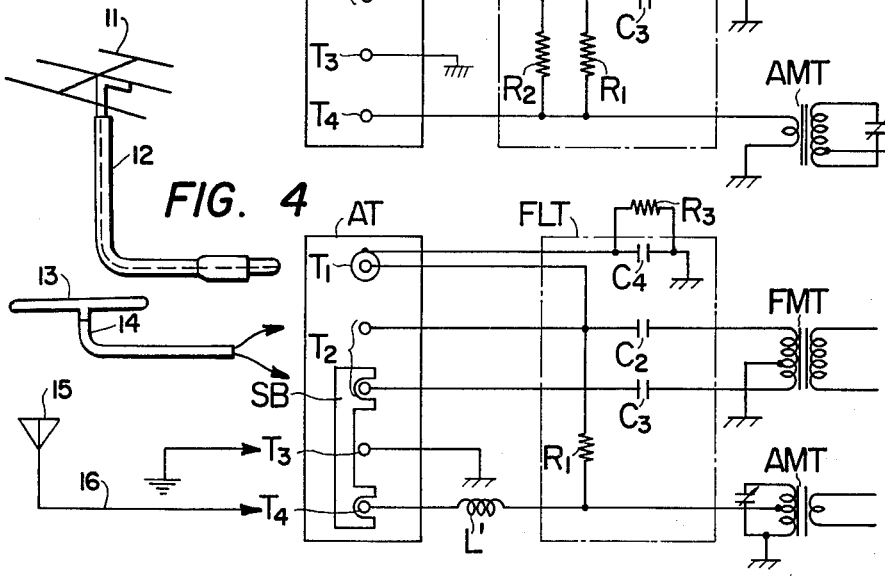
FIG. 4 is an electric circuit diagram showing yet another example of the antenna input circuit according to the present invention.

FIG. 4 is intended to illustrate a modification of the antenna input circuit shown in FIG. 3, and three suitable antennas for possible connection to the antenna input circuit are schematically illustrated. These are antenna 11 connectible through coaxial cable 12 to antenna terminal $T_1$; folded dipole antenna 13 connectible through twin-lead 14 to terminals $T_2$; and AM antenna 15 connectible through a conductor 16 to terminal $T_4$, with terminal $T_3$ being connected to ground. In this antenna input circuit, the resistor $R_2$ in FIG. 3 is omitted and between the contact of the antenna terminal $T_4$ and the primary winding of the input transformer AMT is inserted in series an inductor L'. The inductor L' has such an inductance value that it offers a sufficiently large impedance against FM broadcast signals, but it offers little impedance against AM broadcast signals. The provision of the inductor L' permits only the induced AM broadcast signals, excepting FM broadcast signals, on the twin-lead type feeder 14 connected to the antenna terminal $T_2$ to be directly applied to the input transformer AMT through a circuit-shorting conductor SB which is detachably attached across the antenna terminals $T_2$ and $T_4$.

Frequently, an indoor feeder antenna, which is made of a twin-lead type feeder, is used as an FM-receiving antenna instead of an outdoor one for expedience' sake and/or due to difficulty of the outdoor installation of an antenna. In case such an indoor feeder antenna (antenna 13 and twin-lead 15), for instance, is connected to the antenna terminal $T_2$ to receive AM broadcast signals and in case the intensity of the received AM broadcast signals is insufficient, it is possible to obtain a better receiving condition for AM broadcast signals by making short circuiting between the antenna terminals $T_2$ and $T_4$ through the circuit-shorting conductor SB.

An example of the value set for the respective elements is as follows:

| Resistors $R_1$, $R_3$ | Capacitors $C_2$, $C_3$ | Capacitor $C_4$ | Inductor L' |
|---|---|---|---|
| 10kΩ | 100pF | 1000pF | 10μH |

What is claimed is:

1. An antenna input circuit for an AM/FM radio receiver, comprising:

a first antenna terminal connectible with a shielded coaxial cable from an antenna and having a first contact connectible with the center wire of said coaxial cable and a second contact connectible with the shield sheath of said coaxial cable, said second contact connected to the ground line of said circuit through a capacitor;

a second antenna terminal having third and fourth contacts connectible with a twin-lead type feeder from an antenna;

a third antenna terminal having a fifth contact connectible to a lead wire from an antenna;

a first input transformer including a primary winding having a first lead connected to said first contact and said third contact of the antenna terminals commonly through first AM broadcast signal eliminating means and a second lead connected to said fourth contact through second AM broadcast signal eliminating means; and a second input transformer including a primary winding having a third lead connected to the ground line of said circuit and a fourth lead connected to said first contact and said third contact of the antenna terminals commonly through first FM broadcast signal eliminating means and to said fifth contact of the antenna terminal.

2. The circuit according to claim 1, in which said first and second leads are respective end leads of the primary winding of said first input transformer which primary winding has a center tap connected to the ground line of said circuit.

3. The circuit according to claim 2, in which said fourth contact of the antenna terminal is connected to said fourth lead of said second input transformer through second FM broadcast signal eliminating means.

4. The circuit according to claim 2, in which said fifth contact of the antenna terminal is connected to said fourth lead of said second input transformer through third FM broadcast signal eliminating means.

5. The circuit according to claim 4, further comprising a conductor detachably attached across said fourth contact and said fifth contact of the antenna terminals to connect the fourth contact with the fifth contact.

6. The circuit according to claim 4, in which said third and fourth leads are one end lead and a tap, respectively, of the primary winding of said second transformer which primary winding has the other end lead connected to the ground line of said circuit through a variable capacitor.

7. The circuit according to claim 1, in which said first FM broadcast signal eliminating means is an inductor.

8. The circuit according to claim 3, in which said first and second FM broadcast signal eliminating means are resistors.

9. The circuit according to claim 4, in which said first and third FM broadcast signal eliminating means are a resistor and an inductor, respectively.

10. The circuit according to claim 1, in which said first and second AM broadcast signal eliminating means are capacitors.

11. The circuit according to claim 1, in which a resistor is connected in parallel with said capacitor inserted between said second contact of the antenna terminal and the ground line of said circuit.

12. The circuit according to claim 1, further comprising a fourth terminal connected to the ground line of said circuit and connectible with the earth.

* * * * *